US010161176B1

(12) United States Patent
Schmidt

(10) Patent No.: US 10,161,176 B1
(45) Date of Patent: Dec. 25, 2018

(54) GRAIN BIN COVER OPENING SYSTEM

(71) Applicant: Raymond E. Schmidt, Tioga, ND (US)

(72) Inventor: Raymond E. Schmidt, Tioga, ND (US)

(73) Assignee: NexGen Innovation LLC, Tioga, ND (US)

( * ) Notice: Subject to any disclaimer, the term of this patent is extended or adjusted under 35 U.S.C. 154(b) by 0 days.

(21) Appl. No.: 15/986,187

(22) Filed: May 22, 2018

Related U.S. Application Data

(60) Provisional application No. 62/654,475, filed on Apr. 8, 2018.

(51) Int. Cl.
*E05F 11/00* (2006.01)
*E05F 15/60* (2015.01)
*E05F 15/53* (2015.01)

(52) U.S. Cl.
CPC ..... *E05F 15/60* (2015.01); *E05F 15/53* (2015.01); *E05Y 2201/434* (2013.01); *E05Y 2201/474* (2013.01); *E05Y 2201/624* (2013.01); *E05Y 2600/46* (2013.01); *E05Y 2900/604* (2013.01)

(58) Field of Classification Search
CPC ..... E05F 15/60; E05F 15/53; E05Y 2600/46; E05Y 2201/624; E05Y 2201/434; E05Y 2201/474
USPC ..... 49/357
See application file for complete search history.

(56) References Cited

U.S. PATENT DOCUMENTS 4,208,839 A 6/1980 Candy, Sr.
4,256,029 A 3/1981 Steffen
4,267,936 A 5/1981 Pavlicek
4,327,522 A * 5/1982 Meadows ..... B65D 90/10 49/279
4,526,288 A 7/1985 Schuld
4,598,496 A * 7/1986 Van Daele ..... B65D 90/623 49/343
4,625,888 A 12/1986 Thompson
4,744,183 A * 5/1988 Kruger ..... B65D 90/623 220/262

(Continued)

FOREIGN PATENT DOCUMENTS

CA 2746248 A1 12/2012
CA 2941937 A1 3/2017

(Continued)

OTHER PUBLICATIONS https://web.archive.org/web/20141009173932/http://shortlineag.com/bin%20lids.html; Remote Bin Lids, Shortline Ag Inc.; Oct. 4, 2014.
Pictures of Prior Art Covers; Jan. 1, 2017.

*Primary Examiner* — Jerry E Redman
(74) *Attorney, Agent, or Firm* — Neustel Law Offices

(57) ABSTRACT

A grain bin cover opening system for remotely and safely opening grain bin covers. The grain bin cover opening system generally includes an upper arm adapted to raise or lower a cover, a lower arm connectable to a fixed bracket on the grain bin. The grain bin cover opening system also may include an actuator operably coupled between the upper arm and the lower arm to move the upper arm away from or toward the lower arm, in order to open the cover. The System may also include an inner stiffener coupled to the lower arm, configured to slide into and out of an outer stiffener coupled to the upper arm to maintain a substantially constant angle between the upper arm and the lower arm.

20 Claims, 16 Drawing Sheets

(56) References Cited

U.S. PATENT DOCUMENTS

| | | | | | |
|---|---|---|---|---|---|
| 4,747,244 | A * | 5/1988 | Christianson | B65D 90/10 | 220/262 |
| 5,218,784 | A | 6/1993 | Pollock | | |
| 5,477,980 | A | 12/1995 | Chaffin | | |
| 5,566,506 | A | 10/1996 | Phillips | | |
| 5,655,683 | A | 8/1997 | Goth | | |
| 5,839,597 | A * | 11/1998 | Marttila | B65D 90/10 | 220/264 |
| 5,937,581 | A | 8/1999 | Matye | | |
| 6,952,996 | B2 | 10/2005 | Sisk | | |
| 8,196,362 | B1 * | 6/2012 | Ratts | E05F 11/12 | 49/357 |
| 8,375,637 | B2 * | 2/2013 | Zazula | E05F 11/04 | 49/357 |
| 8,720,079 | B2 | 5/2014 | Neufeld | | |
| 9,051,117 | B2 * | 6/2015 | Kirchhoff | B65D 90/10 | |
| 9,919,867 | B1 * | 3/2018 | Poncsak | B65D 90/623 | |
| 2006/0086551 | A1 * | 4/2006 | Cleland | B62D 25/12 | 180/69.2 |
| 2008/0135555 | A1 | 6/2008 | Watson | | |
| 2012/0084944 | A1 * | 4/2012 | Hirtsiefer | E05D 3/14 | 16/302 |
| 2014/0230330 | A1 * | 8/2014 | Piermee | E02D 29/1418 | 49/279 |
| 2014/0263325 | A1 | 9/2014 | Kirchhoff | | |
| 2017/0073156 | A1 | 3/2017 | Neufeld | | |

FOREIGN PATENT DOCUMENTS

| | | | |
|---|---|---|---|
| CN | 104816900 | B | 7/2017 |
| JP | 5436136 | B2 | 3/2014 |

* cited by examiner

GRAIN BIN COVER OPENING SYSTEM

CROSS REFERENCE TO RELATED APPLICATIONS

I hereby claim benefit under Title 35, United States Code, Section 119(e) of U.S. provisional patent application Ser. No. 62/654,475 filed Apr. 4, 2018. The 62/654,475 application is currently pending. The 62/654,475 application is hereby incorporated by reference into this application.

STATEMENT REGARDING FEDERALLY SPONSORED RESEARCH OR DEVELOPMENT

Not applicable to this application.

BACKGROUND

Field of the Invention

Example embodiments in general relate to a grain bin cover opening system for remotely opening grain bin and hopper bin covers.

Description of the Related Art

Any discussion of the related art throughout the specification should in no way be considered as an admission that such related art is widely known or forms part of common general knowledge in the field.

Grain bins with openings in the top for filling with grain, for example, have been in use for many years. Grain bins are typically quite large, with covers at the top that cannot be directly accessed from the ground. The vast majority of grain bin and hopper bin cover openers that are in use today are designs developed years ago. The types made in the past and still used today are basically a lever and rope or cable type of opener. Other kinds use metal rods to open the grain bin cover. There are a few openers that use a slide mechanism mounted to the cover and by pulling a rope or cable the cover slides open.

There are also a few slide models that require the operator to climb to the top of the bin and slide the cover open by hand. There have been a handful of grain bin or hopper bin cover and/or lid openers that have been introduced over the last few decades using more modern electrically powered motors. The attempts to design such a device have failed to meet the needs of the industry because of the relatively high cost of the main electrical components being used. Because of the costs involved there has been no consumer interest in purchasing such a high-priced bin or hopper bin cover opener.

Without remote operation, opening and closing a grain bin cover requires climbing to the top of the bin on the outside, which can be time consuming, unpleasant, and extremely dangerous.

Therefore, there currently exists a need within the industry for a moderately priced cover opening system that can open, close, and lock in place a grain bin or hopper bin cover, while allowing remote operation (i.e., from the ground).

BRIEF SUMMARY OF THE INVENTION

An example embodiment is directed to a grain bin cover opening system. The grain bin cover opening system includes an upper arm adapted to raise or lower a cover, a lower arm connectable to a fixed bracket, an actuator operably coupled between the upper arm and the lower arm to move the upper arm away from or toward the lower arm. The example embodiment also includes an inner stiffener having a first end and a second end, the first end of the inner stiffener being coupled to the lower arm, and an outer stiffener coupled to the upper arm at one end and adapted to slidably receive the inner stiffener at the other end, wherein the coupling of the inner stiffener to the lower arm maintains a substantially constant angle between the inner stiffener and the lower arm, and wherein the coupling of the outer stiffener to the upper arm maintains a substantially constant angle between the outer stiffener and the upper arm.

In another example embodiment, the actuator of the grain bin cover opening system can include a linear actuator having a push rod. The push rod may be substantially parallel to the inner stiffener, and the inner stiffener can slide into the outer stiffener when the actuator retracts.

In another example embodiment, the grain bin cover opening system further comprises a lift spring inside the outer stiffener that is compressed by the inner stiffener when the actuator retracts. This lift spring can thus absorb shock and enable the actuator to lift a heavier cover, or to simply exert more force on the cover, during operation, since the spring stores energy.

In another example embodiment, the lower arm of the grain bin cover opening system is pivotally connectable to the fixed mounting bracket. During operation, the upper arm and the lower arm maintain a substantially constant angle relative to each other when the actuator is extended or retracted. In a further example embodiment, the actuator and the outer stiffener are coupled to the upper arm through an upper frame member. The upper arm is connectable to a cover mount, and operation of the actuator exerts an opening or a closing force on the cover through the upper arm and the cover mount.

In still another example embodiment, the cover mount of the grain bin cover opening system is connectable to the inside of the cover. In any embodiment, the upper arm may comprise a spring engaging member, and the cover mount can include a first mount spring, wherein the first mount spring is compressed by the spring engaging member when the actuator moves beyond the point where the cover is fully closed. Accordingly, the first mount spring exerts a locking force on the cover.

In another embodiment, the cover mount further comprises a second mount spring, wherein the spring engaging member is held between the first mount spring and the second mount spring.

In still another example embodiment, the lower arm of the grain bin cover opening system pivots during operation of the actuator to increase the distance over which an opening force and a closing force can be exerted on the cover.

In another example embodiment, the grain bin cover opening system includes a cover extension connected to the cover, wherein the upper arm is connectable to a mount attached to the cover extension, and wherein operation of the actuator exerts an opening force on a cover through the upper arm, the cover extension, and the mount. In this example, the elements of the grain bin cover opening system are mounted outside the grain bin, allowing for wide, unobstructed opening of the cover. In this embodiment, the lower arm can be pivotally connectable to a mounting bracket.

There has thus been outlined, rather broadly, some of the embodiments of the grain bin cover opening system in order that the detailed description thereof may be better understood, and in order that the present contribution to the art may be better appreciated. There are additional embodiments of the grain bin cover opening system that will be described hereinafter and that will form the subject matter of the claims appended hereto. In this respect, before explaining at least one embodiment of the grain bin cover opening system in detail, it is to be understood that the grain bin cover opening system is not limited in its application to the details of construction or to the arrangements of the components set forth in the following description or illustrated in the drawings. The grain bin cover opening system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION OF THE INVENTION

A. Overview

Figure 1:
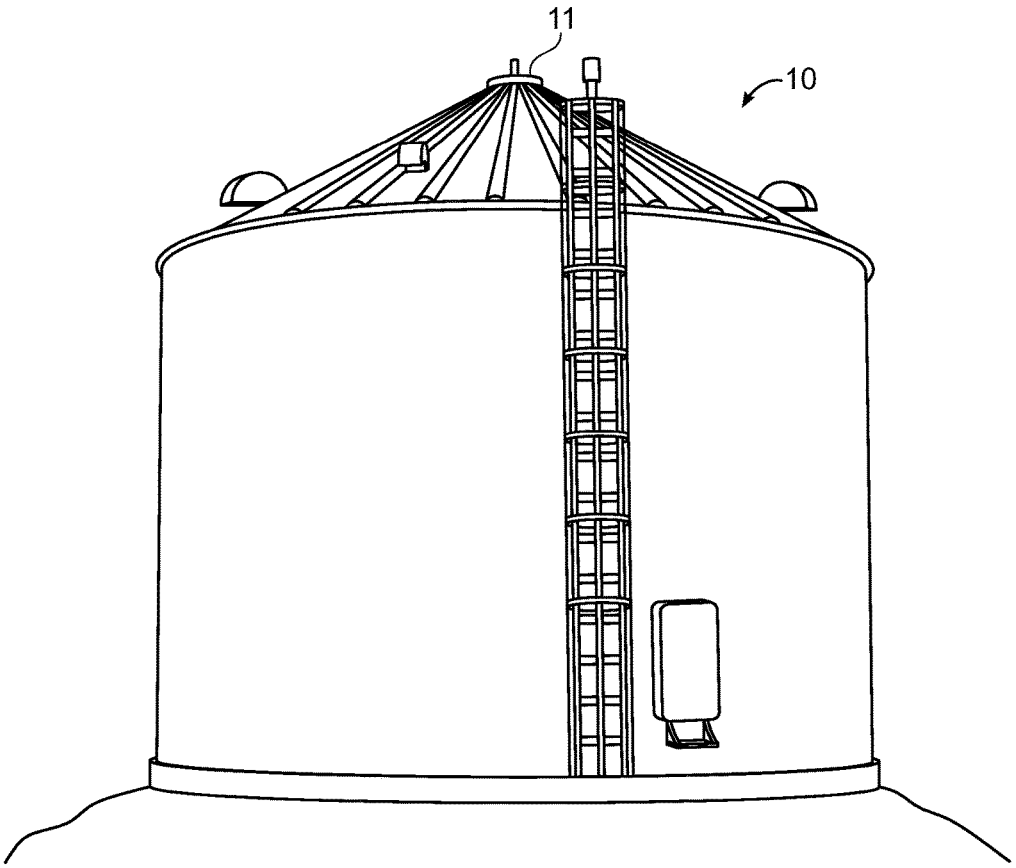
FIG. 1 is a perspective view of a grain bin cover opening system in accordance with an example embodiment, shown with the cover closed.

An example grain bin cover opening system generally comprises a frame 20 that includes an upper frame member 21 and an upper arm 26 attached to a cover mount 40, to raise or lower the cover 11 of a grain bin, a lower arm 51 connected to a fixed bracket 50, and an actuator 30 operably coupled between the upper frame member 21 (or upper arm 26) and the lower arm 51 to move the upper arm 26 away from or toward the lower arm 51. The system may also include an inner stiffener 23 with one end coupled to the lower arm 51 and a second end that slides into an outer stiffener 22 when the actuator 30 is retracted. The actuator 30 may be a linear actuator with an axis of operation that is generally parallel to the axis of the inner and outer stiffeners. The actuator, anchored to the lower arm 51, can exert a closing force or an opening force on the grain bin cover 11 through the upper arm 26.

The outer stiffener may be coupled or connected to the upper arm 26 at one end, opposite to the end that receives the inner stiffener 23. More specifically, the outer stiffener 22 may be securely connected to an upper frame member 21, into which the upper arm 26 is inserted and secured. The attachment of the inner stiffener 23 to the lower arm 51 is preferably rigid, and maintains a substantially constant angle between the inner stiffener 23 and the lower arm 51. Similarly, the attachment of the outer stiffener 22 to the upper frame member 21 or upper arm 26 is also preferably rigid, and maintains a substantially constant angle between the outer stiffener 22 and the upper arm 26.

The upper frame member 21 may also be connected to one end of a side frame member 24 that can be connected to two lower frame members 25*a* and 25*b*. The lower frame members 25*a* and 25*b* are connected at their other ends to the upper stiffener 22. The frame thus forms a substantially rigid rectangular structure that surrounds the linear actuator 30 and as will be discussed, keeps the upper arm 26 parallel to the lower arm 51, or alternatively, ensures that the relative angle between the upper arm 26 and the lower arm 51 is substantially constant, whether the actuator 30 is fully extended, fully retracted, or is somewhere between the two positions. The actuator may be connected with a bolt to the upper frame member 21 at the top of the frame 20. The actuator may be a linear actuator having a push rod 31 that is substantially parallel to the inner stiffener 23. The push rod may be connected to the lower arm 51 by a push rod bolt 29. As noted, in an example embodiment the inner stiffener 23 slides into and out of the outer stiffener 22, as dictated by the motion of the push rod 31. The inner stiffener 23 and outer stiffener 22 thus act together to keep the upper arm 26 and the lower arm 51 parallel, and also to add rigidity and reinforcement to the system, which includes the actuator 30.

Further, an example embodiment of the grain bin cover opening system may include a lift spring 70 that fits inside the outer stiffener 22. The lift spring 70 is compressed by one end of inner stiffener 23 when the inner stiffener slides farther into the outer stiffener 22. The lift spring 70 serves to absorb shock when the cover is opened or closed, and it also retains energy upon compression that can be used to assist in opening or closing the grain bin cover, depending on the configuration.

Accordingly, during operation, unlike other linear actuator systems where a linear actuator may be pivotally connected at both ends, the upper arm and upper frame member 21 stay substantially parallel to the lower arm 51, which is pivotally mounted to a grain bin with a bracket 50 and a pivot bolt 52—for example, inside the opening, or alternatively, outside the opening. Similarly, the upper arm 26 is coupled somewhat loosely to the cover mount by a spring engaging member 47 that is held within the cover mount due to its size (i.e., once inserted, the spring engaging member 47 can move along the axis of the cover mount, but cannot fit through the opening 44. The rigidity of the opening system's frame 20 permits the actuator 30 to be offset from the effective pivot point where the upper arm is coupled to the cover by a relatively large distance. In addition, because the lower arm 51 is forced to pivot in the direction of opening when the actuator is operated (since it remains parallel to the upper frame member and upper arm), the actuator can open the cover farther than a linear actuator of the same design simply connected directly between a pivot point on the cover and a fixed pivot point on the grain bin.

The opening system as described thus forms a rigid frame 20 that can be actuated to open and close a grain bin cover, remotely and with little effort by a user. For example, the actuator 30 that opens and closes the cover may be an electrically powered linear actuator, although other configurations (e.g., hydraulic, pneumatic, etc.) are possible. The rigidity of the frame 20 adds strength to the system, and furthermore, allows the actuator to be offset from the pivot point of the cover 11, which permits wider opening of the cover.

In an example embodiment, the actuator 30 and the outer stiffener 22 may be coupled to the upper arm 26 through an upper frame member 21. Further, the upper arm 26 is connectable to a cover mount 40, so that operation of the actuator exerts an opening force on the cover 11 through the upper arm and the cover mount. The cover mount is connectable to the inside of the cover, or it may be connected to a cover extension on the outside of the cover.

In another example embodiment, the upper arm of the grain bin cover opening system may comprise a spring engaging member 47, and the cover mount can comprise a lower mount spring 41, wherein the lower mount spring is compressed by the spring engaging member 47 when the actuator 30 moves beyond the point where the cover is fully closed, so that the lower mount spring 41 exerts a locking force on the cover 11. In this embodiment, the cover mount 40 may further include an upper mount spring 42, arranged so that the spring engaging member 47 is held between the lower mount spring 41 and the upper mount spring 42.

In some example embodiments, the lower arm of the grain bin cover opening system pivots during operation of the actuator 30 to increase the distance over which an opening force and a closing force can be exerted on the cover 11. The lower arm 51 is forced to pivot due to the frame rigidity of the system, and because the inner stiffener is rigidly attached (i.e., non-pivotally) to the lower arm. Without this system, if a linear actuator were simply connected directly to a fixed point, the actuator would not be able to open the cover 11 as far, and may not have the ability to open the cover with a large amount of offset between the cover 11 and the actuator pivot point. This offset allows the grain bin opening to be relatively unobstructed by the actuator 30 when the cover 11 is fully opened.

In an alternate configuration, an example grain bin cover opening system of may include a cover extension 14 connected to the cover, wherein the upper arm 26 is connectable to a cover mount 40 attached to the cover extension 14, and wherein operation of the actuator 30 exerts an opening force on the cover 11 through the upper arm, the cover extension, and the cover mount. In this example embodiment, the opening system is mounted on the outside of the bin cover. Also in this embodiment, the lower arm 51 is pivotally connectable to a mounting bracket 50. As with other example embodiments, the upper arm 26 may also include a spring engaging member 47, and the mount may include a lower mount spring 41 and an upper mount spring 42, wherein the upper mount spring 41 is compressed by the spring engaging member when the actuator moves beyond the point where the cover is fully closed, the first mount spring exerting a locking force on the cover.

Also, as with other embodiments, where the opening system is mounted outside the bin, the opening system can include a lift spring 70 inside the outer stiffener 22 that is compressed by the inner stiffener 23 when the actuator 30 retracts. In this embodiment, the upper arm 26 and the lower arm 51 maintain a substantially constant angle relative to each other when the actuator 30 is extended or retracted, and the lower arm 51 pivots during operation of the actuator 30 to increase the distance over which an opening force and a closing force can be exerted on the cover 11.

Figure 12:
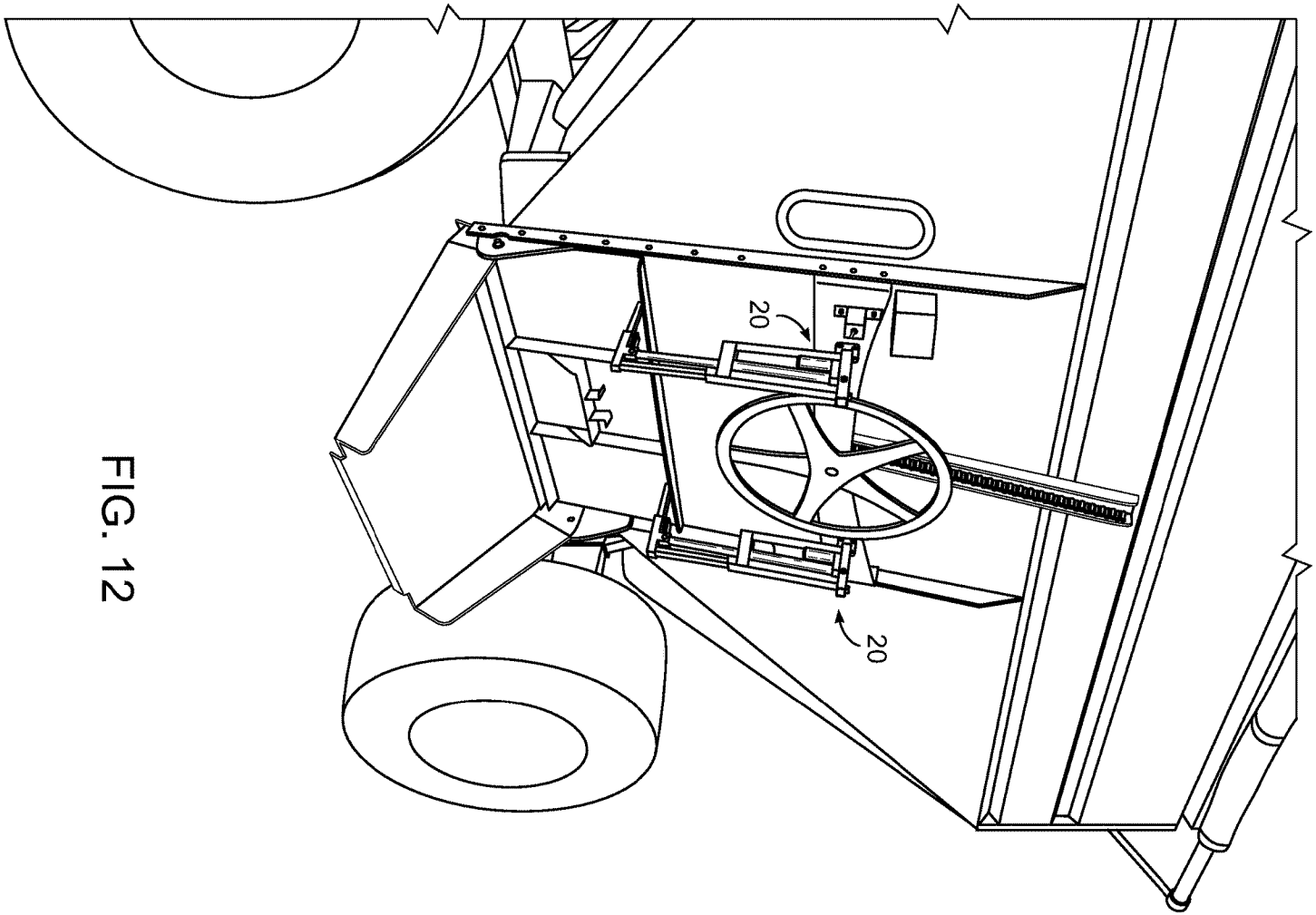
FIG. 12 is a perspective view of an alternative configuration of an installed actuator/frame assembly of a grain bin cover opening system in accordance with an example embodiment.
Figure 13:
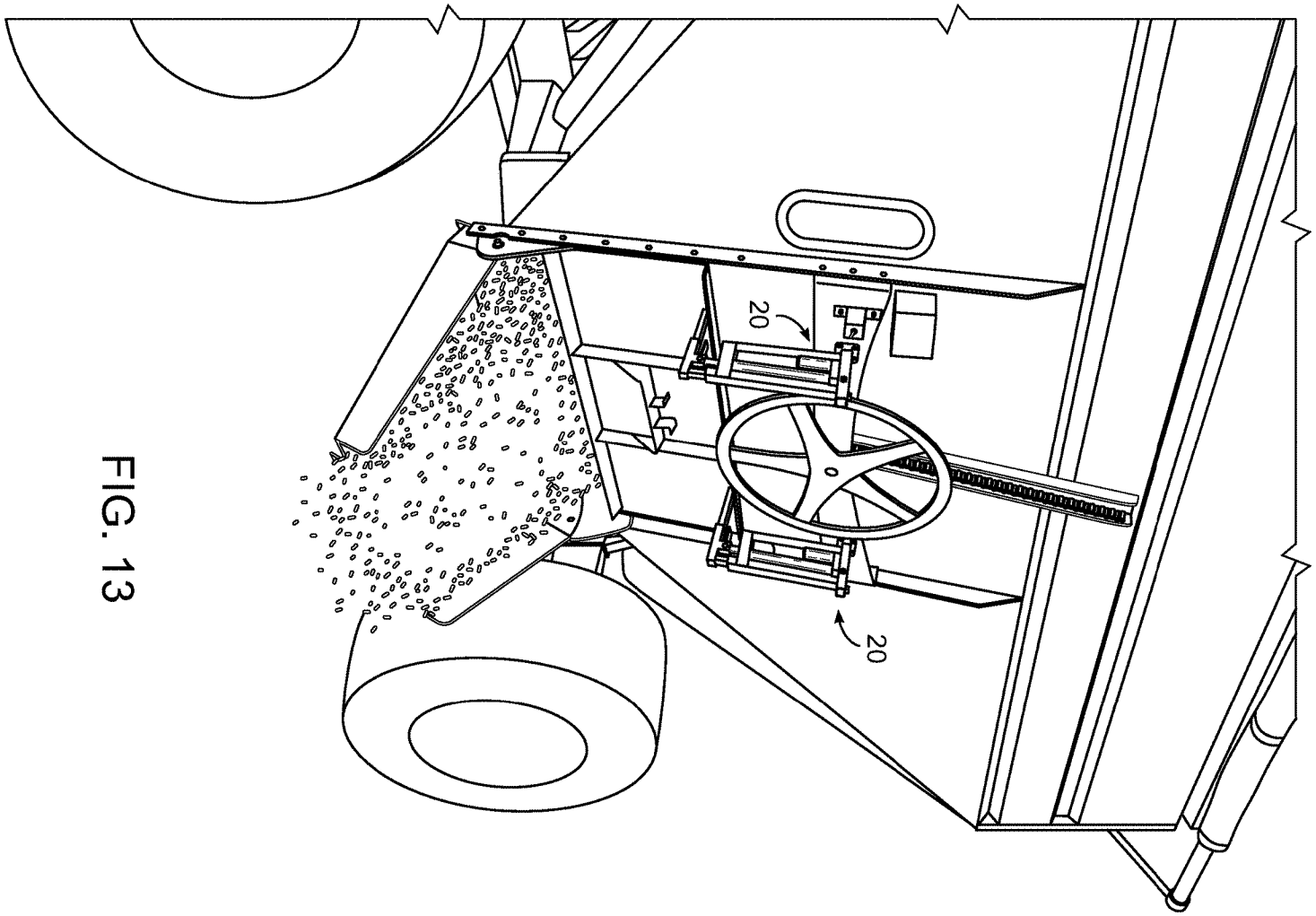
FIG. 13 is another perspective view of an alternative configuration of an installed actuator/frame assembly of a grain bin cover opening system in accordance with an example embodiment.

As shown in FIGS. 12 and 13, the system can also be used in place of any linear actuator where additional strength or actuation force is required or desirable. In these example embodiments, the system is shown mounted on a non-pivoting grain hopper opening, with one actuator/frame on each side of the opening. FIG. 12 shows the system with the hopper door closed, in which case each actuator is in its extended position. FIG. 13 illustrates the same embodiment with the hopper door open, which is a result of the actuators being retracted. In this example embodiment, the two systems (and specifically, the actuators) would be wired in parallel, and have their limit switches adjusted to stop at the same actuation point to open the hopper door smoothly and without jamming or cocking. As will be understood by those of ordinary skill in the art, other applications are possible as well.

B. Frame

Figure 3:
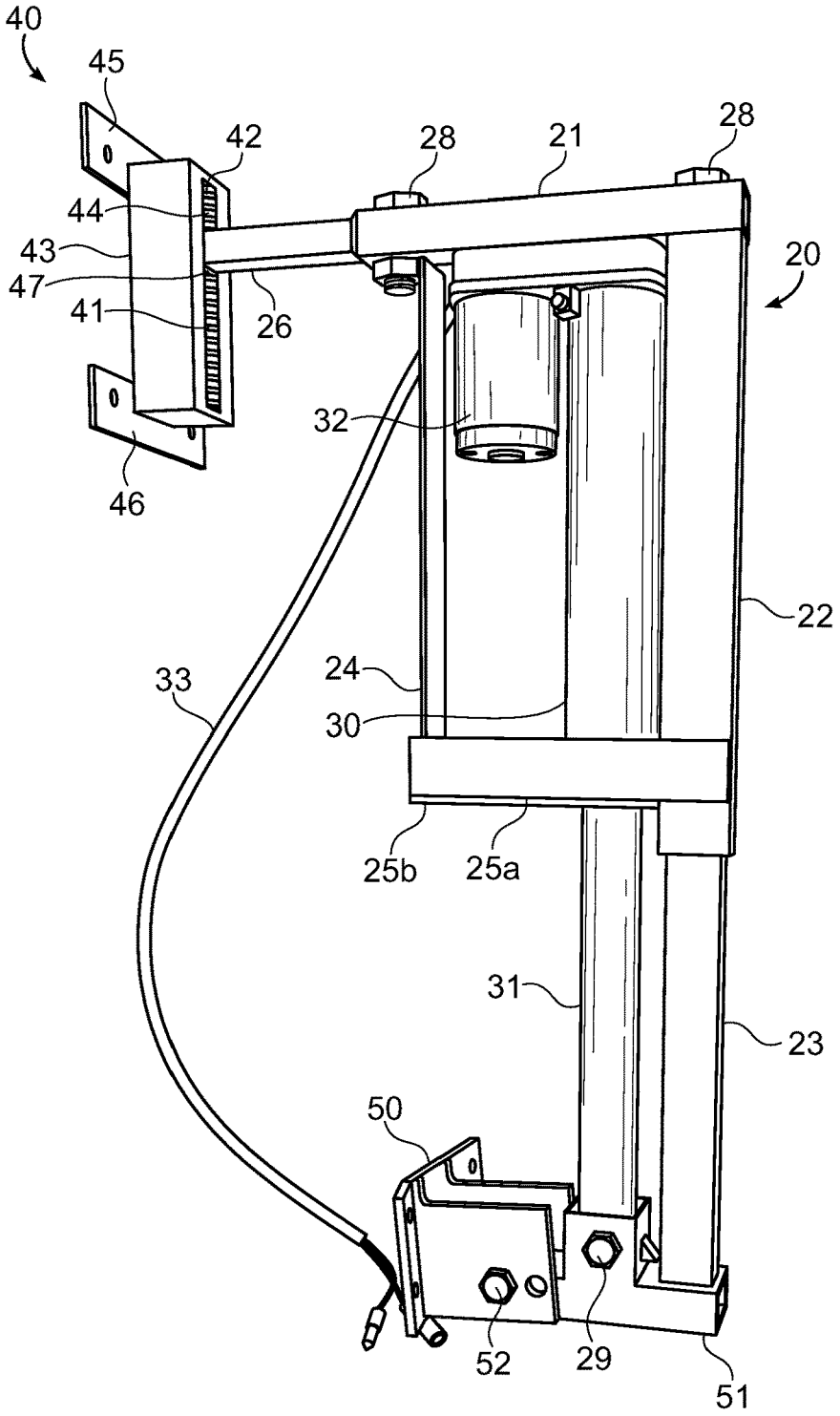
FIG. 3 is a detail perspective view of a grain bin cover opening system in accordance with an example embodiment.
Figure 4:
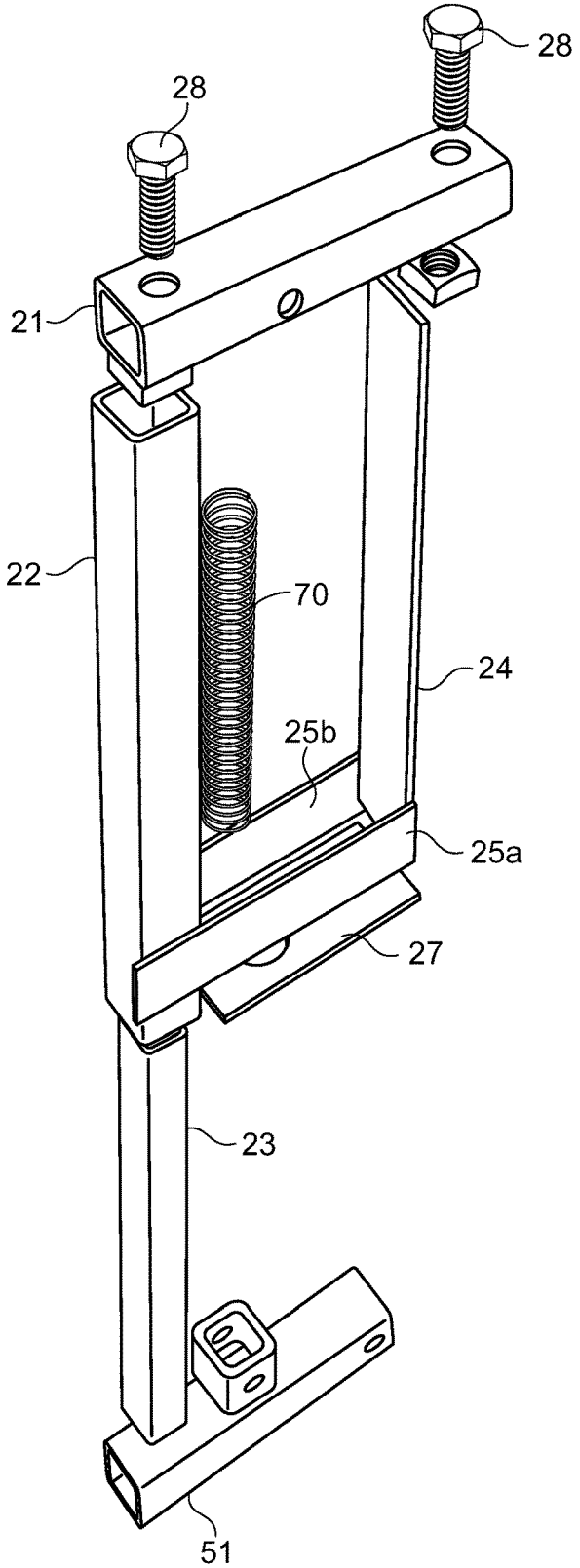
FIG. 4 is an exploded view of the main frame components of a grain bin cover opening system in accordance with an example embodiment.

As best shown in FIGS. 3 and 4, an example grain bin cover opening system includes a substantially rigid frame 20. The frame 20 includes an upper frame member 21 that is coupled to an upper arm 26 attached to a cover mount 40, to raise or lower the cover 11 of a grain bin. The frame 20 also includes or attaches to a lower arm 51 connected to a fixed bracket 50, and an actuator 30 operably coupled between the upper frame member 21 (or upper arm 26) and the lower arm 51 to move the upper arm 26 away from or toward the lower arm 51. The frame may also include an inner stiffener 23 with one end coupled to the lower arm 51 and a second end that slides into an outer stiffener 22 when the actuator 30 is retracted.

Like the outer stiffener 22, the inner stiffener may be a hollow, square or rectangular cross-sectional tube, but the end the slides into the outer stiffener 22 may be closed, to better engage a lift spring 70 inside the outer stiffener 22. The actuator 30 may be a linear actuator with an axis of operation that is generally parallel to the axis of the inner and outer stiffeners. The actuator, anchored to the lower arm 51, can exert a closing force or an opening force on the grain bin cover 11 through the upper arm 26.

The outer stiffener may be coupled or connected to the upper arm 26 at one end, opposite to the end that receives the inner stiffener 23. More specifically, the outer stiffener 22 may be securely connected to the upper frame member 21, into which the upper arm 26 is inserted and secured, for example by a bolt 28. The attachment of the inner stiffener to the lower arm is preferably rigid, and maintains a substantially constant angle between the inner stiffener 23 and the lower arm 51. Similarly, the attachment of the outer stiffener 20 to the upper frame member 21 or upper arm 26 is also preferably rigid, and maintains a substantially constant angle between the outer stiffener and the upper arm. As shown in FIG. 4, the outer stiffener 22 may be attached to the upper arm 21 by a bolt 28 that extends through the upper frame member 21 and screws into a nut welded or otherwise attached to the inside of the outer stiffener.

The upper frame member 21 may also be connected to one end of a side frame member 24 that can be connected to two lower frame members 25*a* and 25*b*. The lower frame members 25*a* and 25*b* are connected at their other ends to the upper stiffener 22, and are generally parallel to each other and to the upper frame member 21. The frame also includes a bottom frame member 27 that is secured to 25*a* and 25*b*. Bottom frame member 27 is also a length of flat bar with a drilled hole through which the push rod 31 passes, so that the linear actuator is held in place relative to the frame at three points, which adds strength to the actuator and the overall system.

The frame thus forms a substantially rigid rectangular structure that surrounds the linear actuator 30 that keeps the upper arm 26 parallel to the lower arm 51, or ensures that the relative angle between the upper arm 26 and the lower arm 51 is substantially constant, whether the actuator 30 is fully extended, fully retracted, or is somewhere between the two positions. The frame also ensures that the axis of operation of the linear actuator 30 is substantially parallel to the axis of the inner and outer stiffeners 23 and 22, respectively. The inner stiffener 23 is sufficiently long so that when the actuator 30 is fully extended, the inner stiffener 23 remains within the outer stiffener 22, so that the frame will not come apart in any position.

In an example embodiment, side frame member 24 and lower frame members 25*a* and 25*b* can be made of flat steel bars, while the outer stiffener 22, inner stiffener 23, and upper frame member 21 can be made of square tubing. These major frame elements can be welded together, or alternatively can be integrally formed or joined by other means, such as nuts and bolts. As shown in FIG. 3, upper frame member 21 is longer than side members 25*a* and 25*b*, to provide part of the offset that separates the actuator and stiffeners from the cover.

The grain bin cover opening system may also include a lift spring 70 that fits inside the outer stiffener 22. The lift spring 70 is compressed by one end of inner stiffener 23 when the inner stiffener slides farther into the outer stiffener 22. The lift spring 70 serves to absorb shock when the cover is opened or closed, and it also retains energy upon compression that can be used to assist in opening or closing the grain bin cover, depending on the configuration.

C. Actuator

Figure 7:
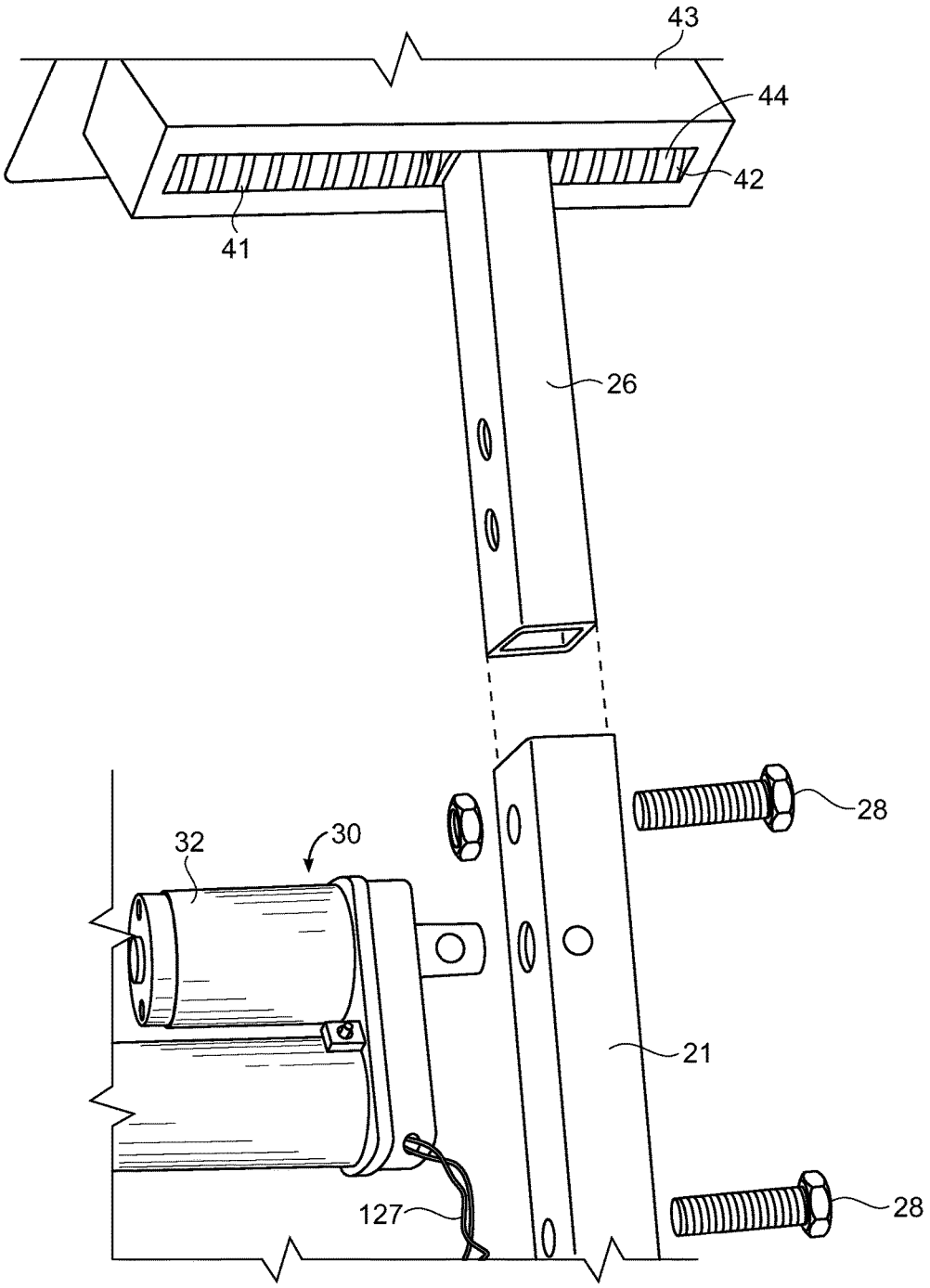
FIG. 7 is a detail exploded view of the upper components and cover mount of a grain bin cover opening system in accordance with an example embodiment.

The actuator 30 may be connected with a bolt (not shown) to the upper frame member 21 at the top of the frame 20 as best shown in FIG. 7, although other connections are possible. The actuator may be a linear actuator having an electric motor 32 and a push rod 31 that is substantially parallel to the inner stiffener 23. The push rod may be connected to the lower arm 51 by a push rod bolt 29, as shown in FIG. 3. More specifically, the actuator may be a ball-screw type of electric actuator, with a square thread profile so that the actuator can't be back-driven by forces applied to it. In an example embodiment, the actuator may run off of 12 volts DC (other voltages, either AC or DC are possible too), so that a source (such as a tractor battery or electrical supply) can be plugged into the system at ground level to provide power. Linear actuators of the size and type usable with this system are typically 12, 24, 36, or 120 volt types. The ground-based power source may also include an on-off-on switch to control the opening system by plugging the system's wiring into a mating connector (the system may, for example, have a male-type wiring connection, connectable to a female connector for control).

Typically, the actuator direction can be easily reversed by reversing the polarity of the voltage applied to it. A commercially available linear actuator may be used with the system, and typically, such linear actuators have built-in limit switches that automatically stop the actuator at the fully extended and fully retracted positions, with some adjustability. With such an actuator, operation of the system can be somewhat automatic, allowing an operator to simply flip a switch or press a button (such as a remote control button) without the need to then stop the actuator by taking further manual action. However, by removing power at any time, the system can be stopped, and will hold, at any desired position.

As mentioned above, the linear actuator can also be a pneumatic or hydraulic actuator, as well as electric. As would be understood by those of ordinary skill in the art, any number of grain bin cover opening systems as described here could be wired in parallel, so that throwing a single switch will cause multiple bins to be opened at the same time. In addition, the system could easily be used in conjunction with a wireless remote control system, much like a garage door opener, to remotely open or close one or more grain bins from ground level.

D. Mounting Bracket/Lower Arm

Figure 5A:
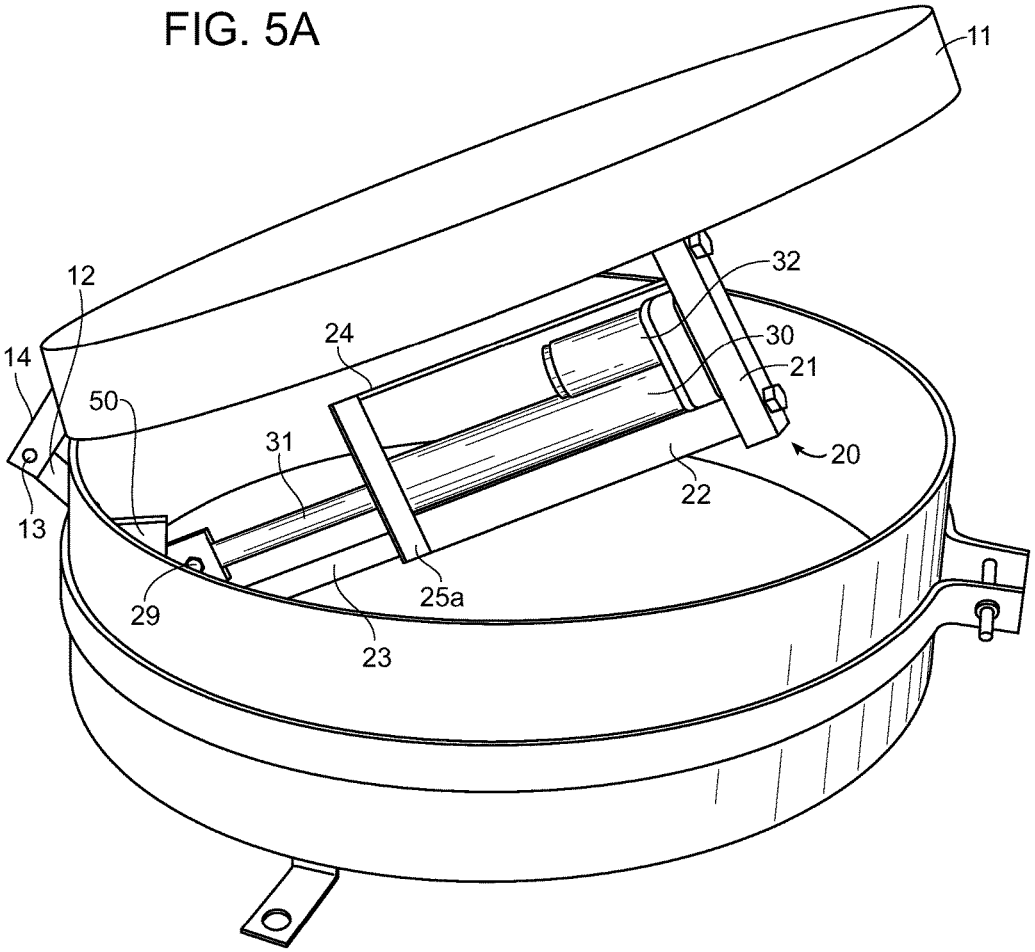
FIG. 5A is another detail perspective view of an installed grain bin cover opening system in accordance with an example embodiment.
Figure 5B:
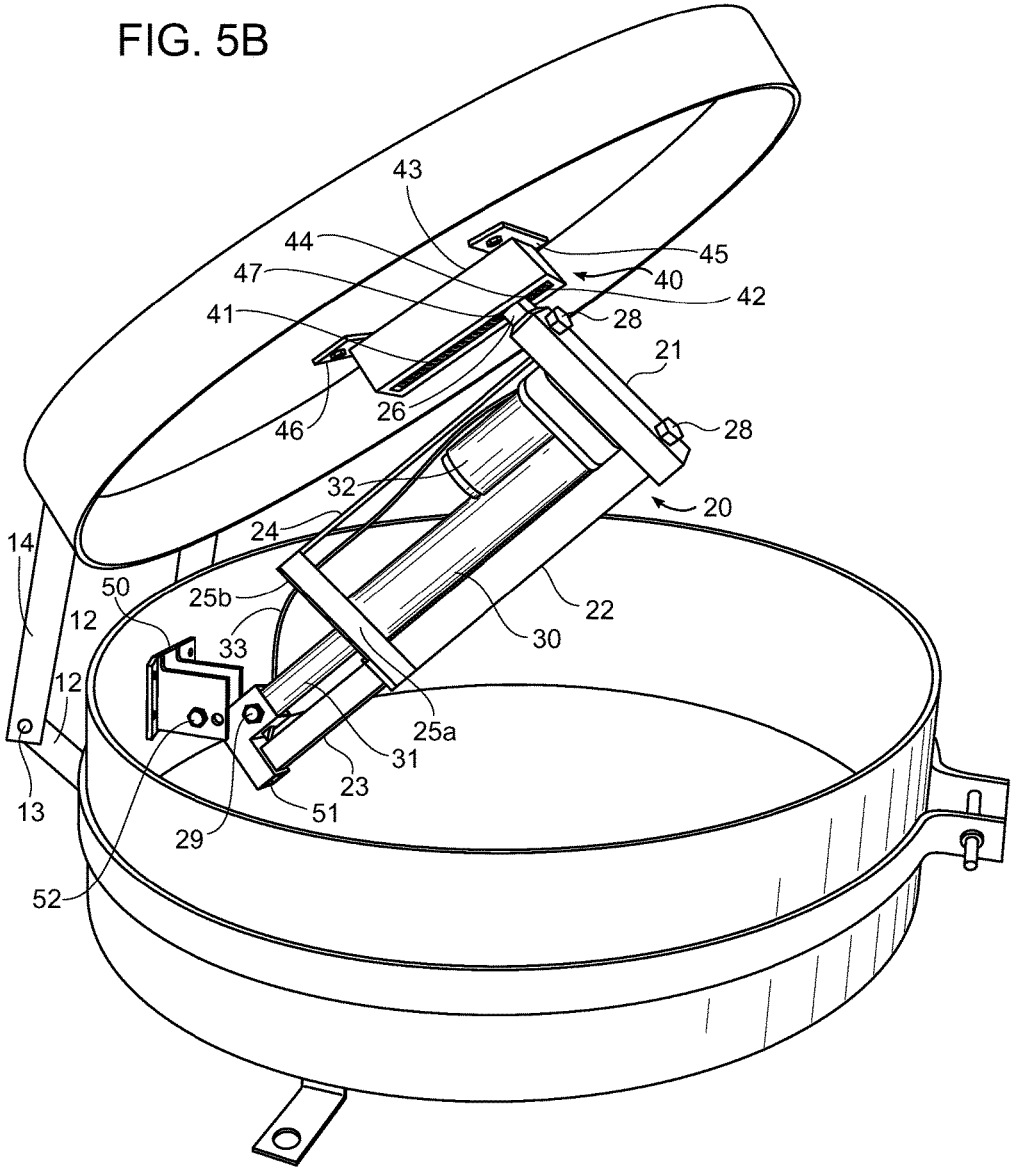
FIG. 5B is another detail perspective view of an installed grain bin cover opening system in accordance with an example embodiment.
Figure 10:
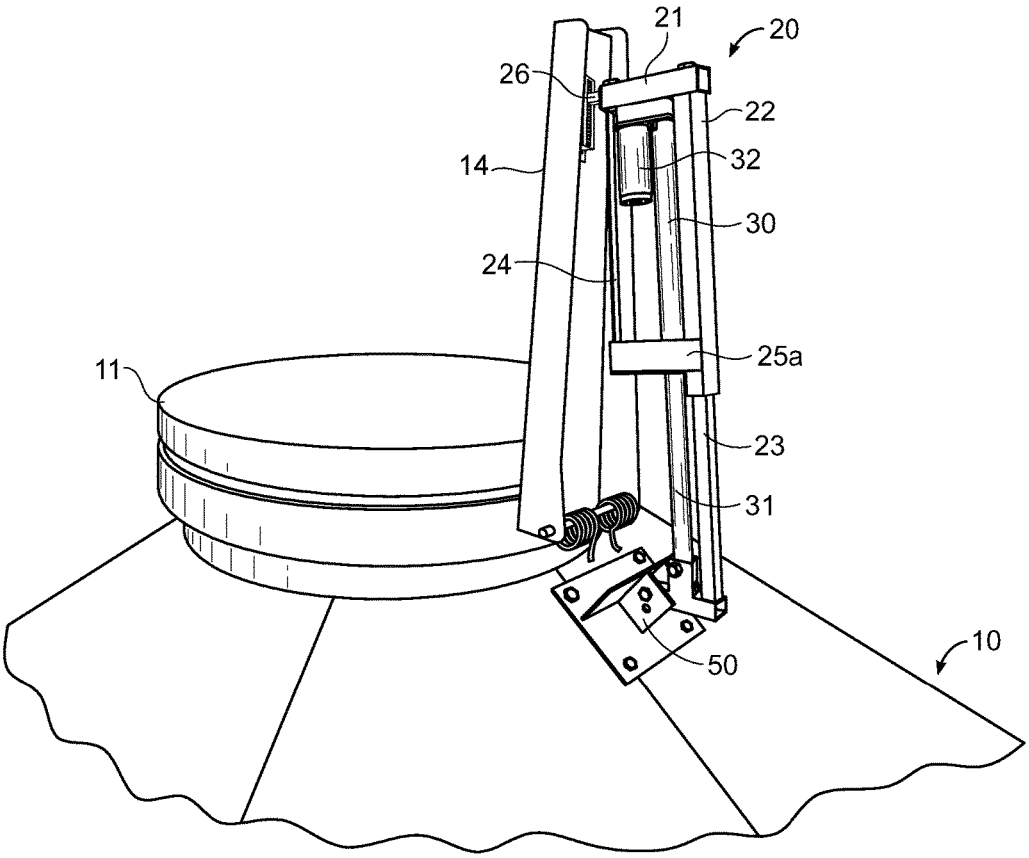
FIG. 10 is a detail perspective view of an alternative configuration of an installed grain bin cover opening system in accordance with an example embodiment, shown with the cover closed.
Figure 14:
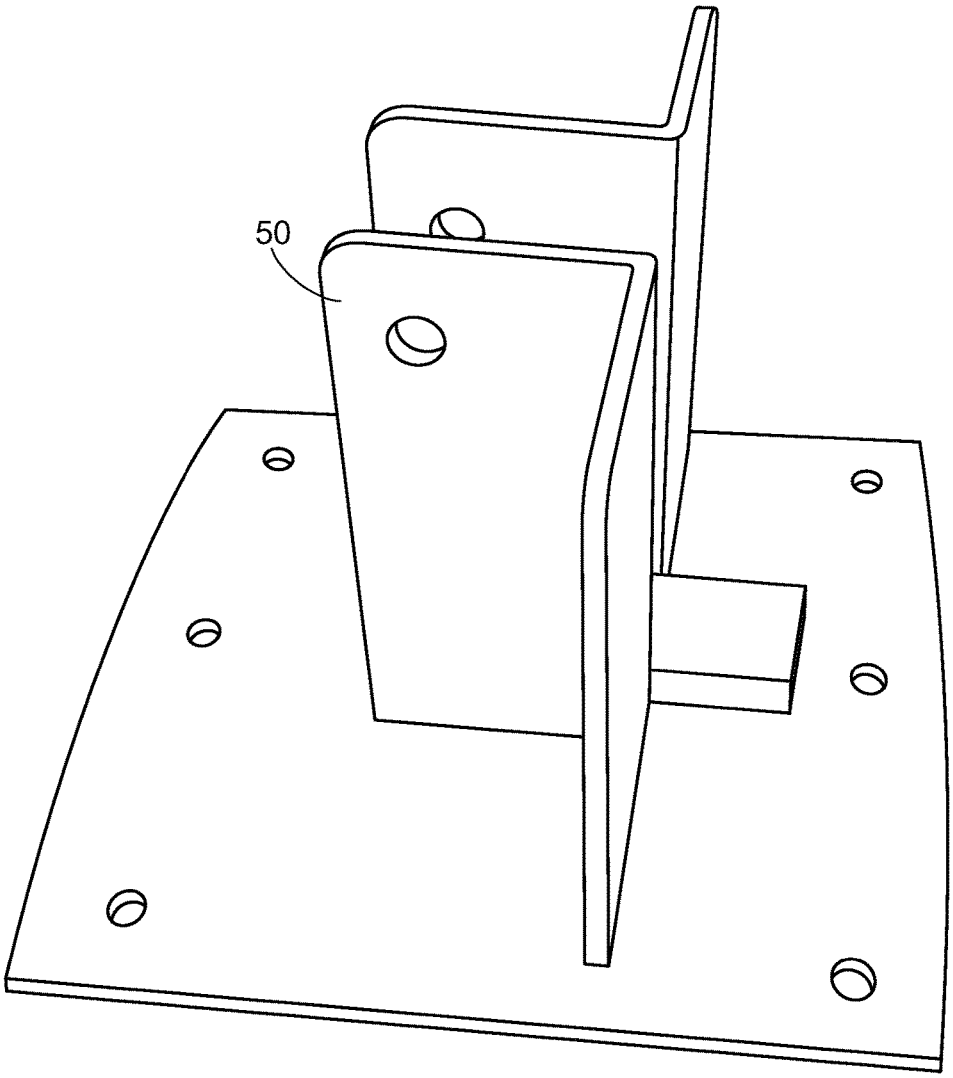
FIG. 14 is a perspective view of a mounting bracket of a grain bin cover opening system in accordance with an example embodiment.

As best shown in FIGS. 3 and 5B, an exemplary system may comprise a mounting bracket 50, which is typically mounted to a fixed point on a grain bin 10 (or the collar), either outside the cover as shown in FIG. 10, or inside, as shown in FIG. 5B. The mounting bracket may be screwed or otherwise securely attached to a fixed part of the bin 10, to provide a pivot point for the lower arm 51 of the actuator/frame assembly. For mounting on the outside of a grain bin, the mounting surface of the bracket 50 may be somewhat curved, as shown in FIG. 14.

E. Cover Mount

Figure 5C:
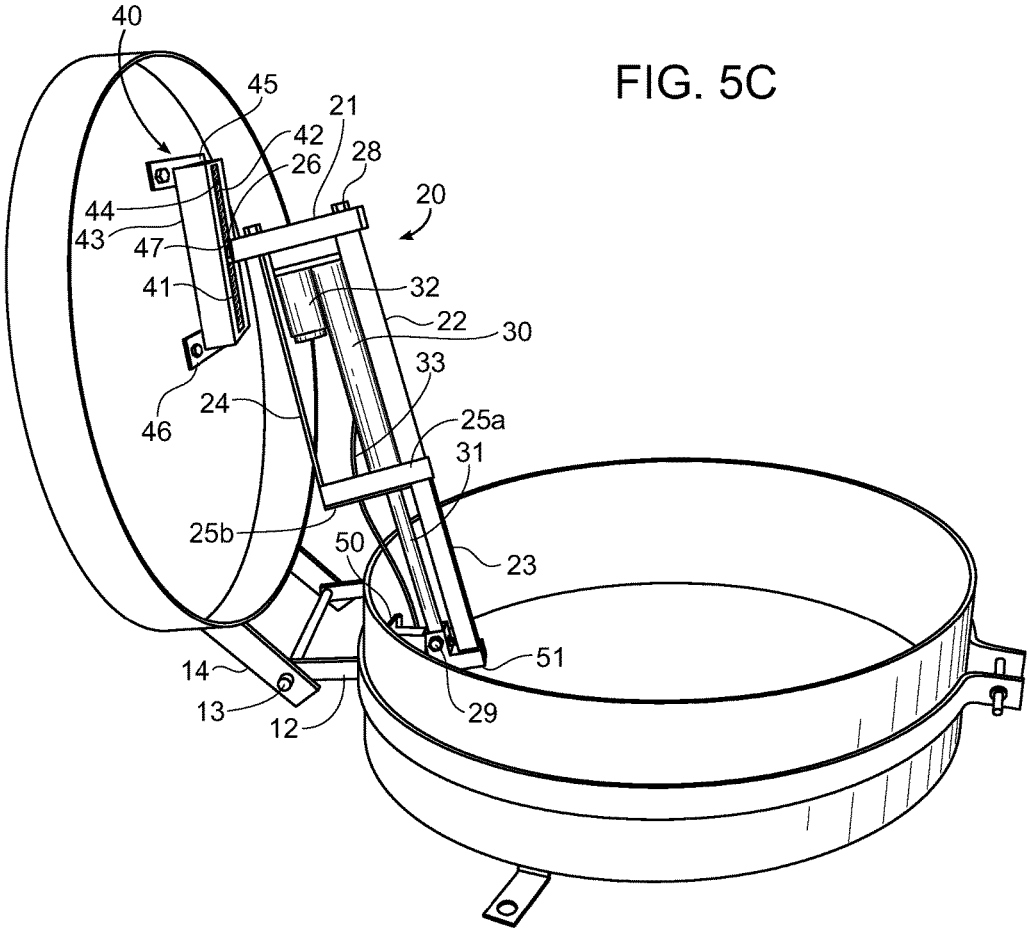
FIG. 5C is another detail perspective view of an installed grain bin cover opening system in accordance with an example embodiment.
Figure 6:
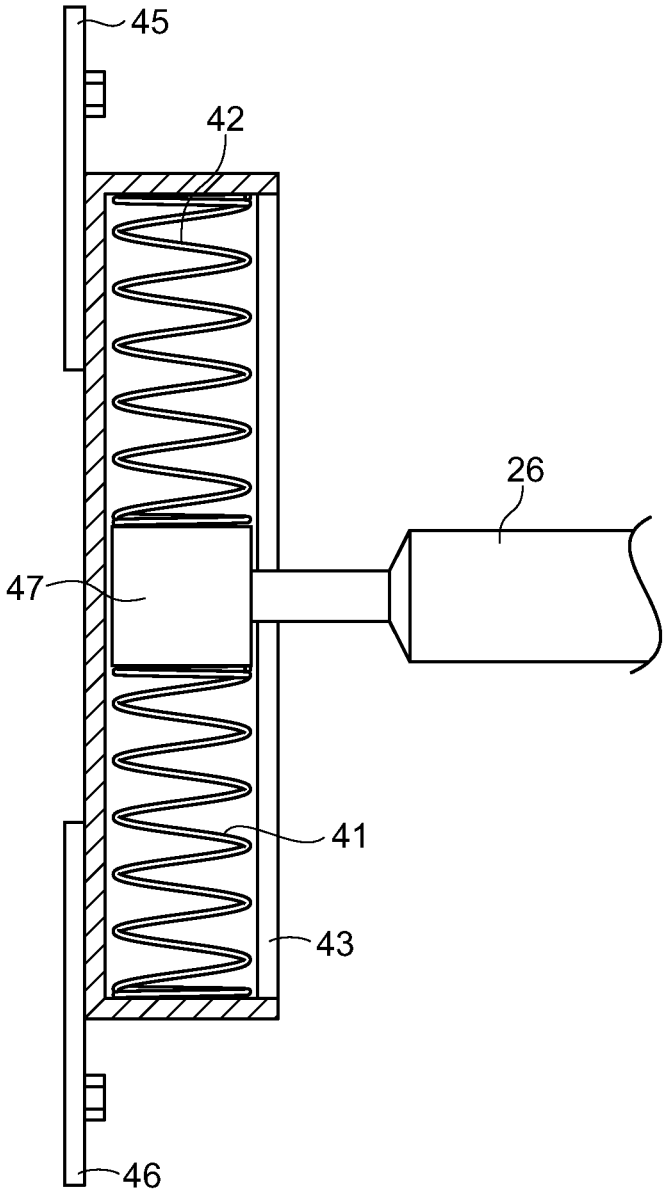
FIG. 6 is a detail, section view of a cover mount of a grain bin cover opening system in accordance with an example embodiment.

As best shown in FIGS. 5B, 5C, and 6, the system may also include a cover mount that is useful for connecting the actuator/frame to a grain bin cover. As discussed earlier, the upper arm 26 includes a spring-engaging member 47. Rather than being directly connected to the cover, the spring-engaging member is positioned between, and held by, two compression springs 41 and 42 that are in turn held within a channel 43. As shown in FIGS. 5 and 6, the channel 43 may be in the form of a square tube with closed ends and a lengthwise slot or opening 44 to accept upper arm 26 and retain spring engaging member 47. The channel 43 may be coupled to cover 11 by an upper mounting plate 45 and a lower mounting plate 46, which can be bolted to the cover 11.

Channel 43 can be attached to the mounting plates by welding, for example. This spring mounting system has several functions. First, when the cover is fully closed, one of the springs will be compressed, depending on whether the system is mounted on the outside of the grain bin, or inside. Typically, the system would be adjusted so that the linear actuator travels about ½" beyond the point where the cover is fully closed. Thus, the extra travel compresses either spring 41 or 42, which helps lock the cover in place against wind, etc. The compression also stores energy in the compressed spring, which then, like lift spring 70, provides additional opening force. Combined with the rigid frame, the additional force from springs 41 (or 42) and 70 allow a smaller, lighter linear actuator to be used than would otherwise be required.

As best shown in FIG. 6, channel 43 is closed to hold in springs 41 and 42, except for a lengthwise channel opening 44 which is large enough to allow a portion of upper arm 26 to pass into the channel, but not large enough to allow spring-engaging member 47 to pass through. Thus, the springs 41, 42, and spring-engaging member 47, can freely move linearly within the channel, but cannot come apart.

F. Operation of Preferred Embodiment

Figure 2:
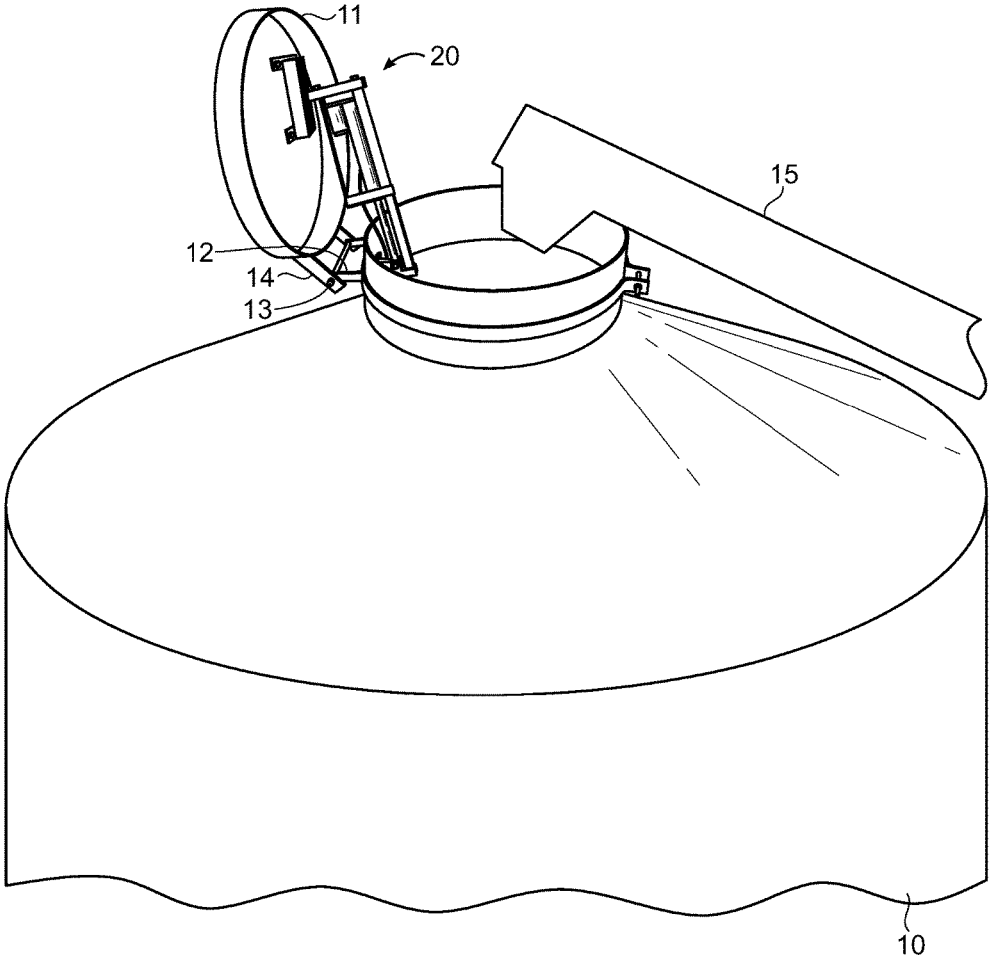
FIG. 2 is another perspective view of a grain bin cover opening system in accordance with an example embodiment, shown with the cover open.

In use, the grain bin cover opening system may be may be mounted on the inside or outside of a grain bin, as shown in FIGS. 2 and 10, for example. If mounted on the inside, as shown in FIG. 2, the cover is opened when the actuator 30 is extended. When the actuator is operated, as best shown in FIGS. 5A-5C, an inner stiffener 23 slides in and out of outer stiffener 22, which adds rigidity and strength to the system, since the inner stiffener 23 fits closely within outer stiffener 22, so that the two components remain parallel to each other. This sliding action and parallel relationship helps ensure that upper arm 26 and lower arm 51 stay parallel to each other, which as described herein, provides several benefits.

Figure 9:
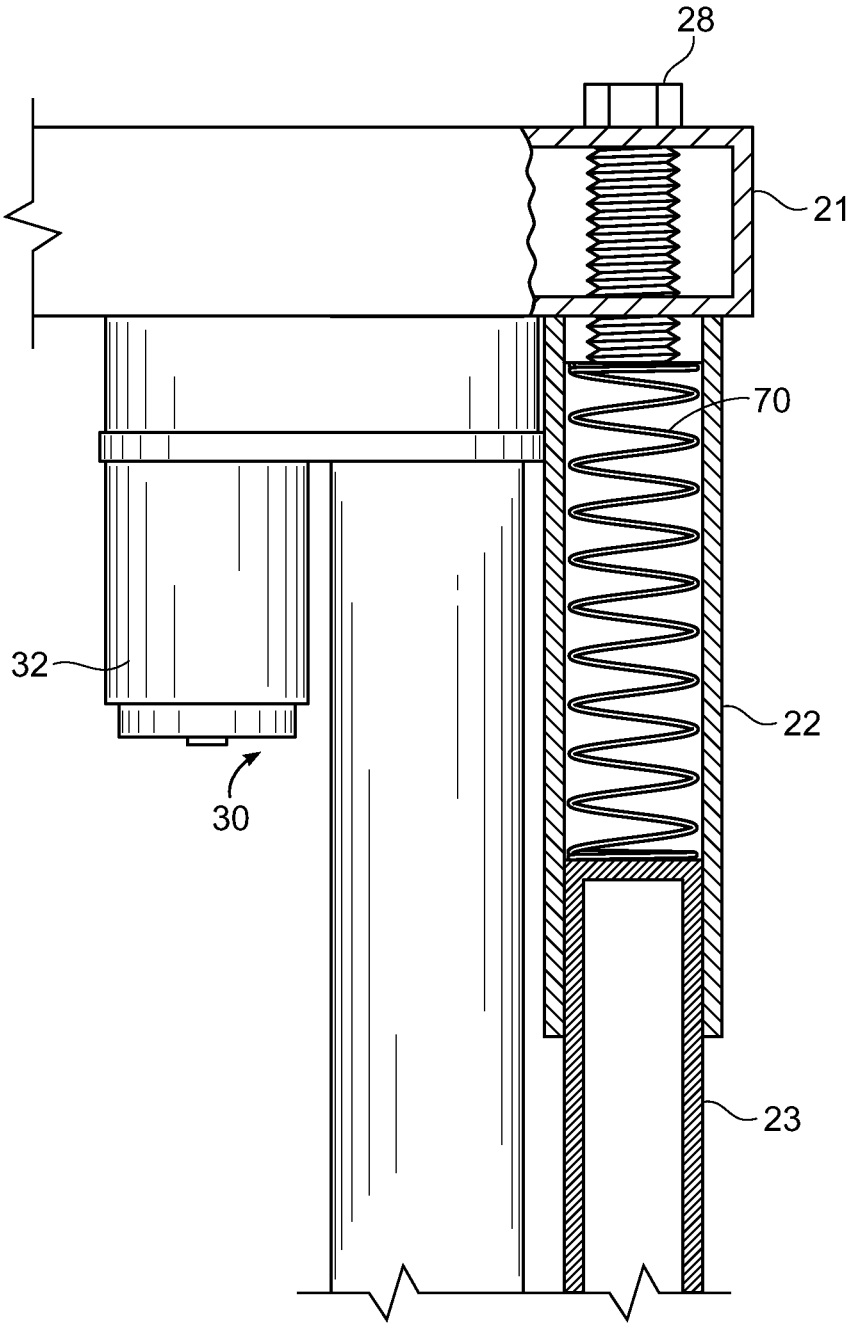
FIG. 9 is a detail, partially sectional view illustrating an internal lift spring of a grain bin cover opening system in accordance with an example embodiment.

In addition to the parallel relationship between the inner stiffener and the outer stiffener, the configuration (as best shown in FIG. 9) allows a lift spring 70 to be mounted inside the outer stiffener 22. As discussed herein, this lift spring 70 is compressed when the inner stiffener 23 slides into outer stiffener 22, and expands when the inner stiffener 23 slides back out.

In this configuration, the lift spring 70, having been compressed upon closing of cover 11, will supply added opening force to the system, thus requiring less opening force to be provided by actuator 30. In this example embodiment, the cover mount 40 of the opening system is connectable to the inside of the cover 11. In this and other embodiments, the upper arm 26 may include a spring engaging member 47, and the cover mount can include two mount springs 41 and 42. When mounted on the inside of cover 11, mount spring 41 is compressed by the spring engaging member 47 when the actuator moves beyond the point where the cover is fully closed. Accordingly, the first mount spring exerts a locking force on the cover. In this embodiment, the spring engaging member 47 is held between the mount spring 41 and the mount spring 42. As with the lift spring 70, mount spring 41 is also compressed when the cover 11 is fully closed, and it too will exert additional opening force to the cover when the actuator 30 is operated and begins to extend to open the cover.

By using the springs 41 and 42 rather than a single pivot attachment on the cover 11, the system absorbs shock during opening and closing (regardless of whether the system is mounted inside or outside the grain bin). Thus, when the cover 11 closes, for example, it will not abruptly slam shut. Further, because of the added strength that the frame and springs provides to the actuator, the actuator is not affected whether it is mounted in either direction—that is, with the actuator motor nearest the cover, or with the motor end attached to the fixed mount on the bin. Accordingly, as shown in FIGS. 2 and 5A-5C, the important parts of the actuator (i.e., the motor and the actuator mechanism) will always be clear of the grain auger 15 as it moves over the grain bin opening, as shown in FIG. 2.

Figure 8:
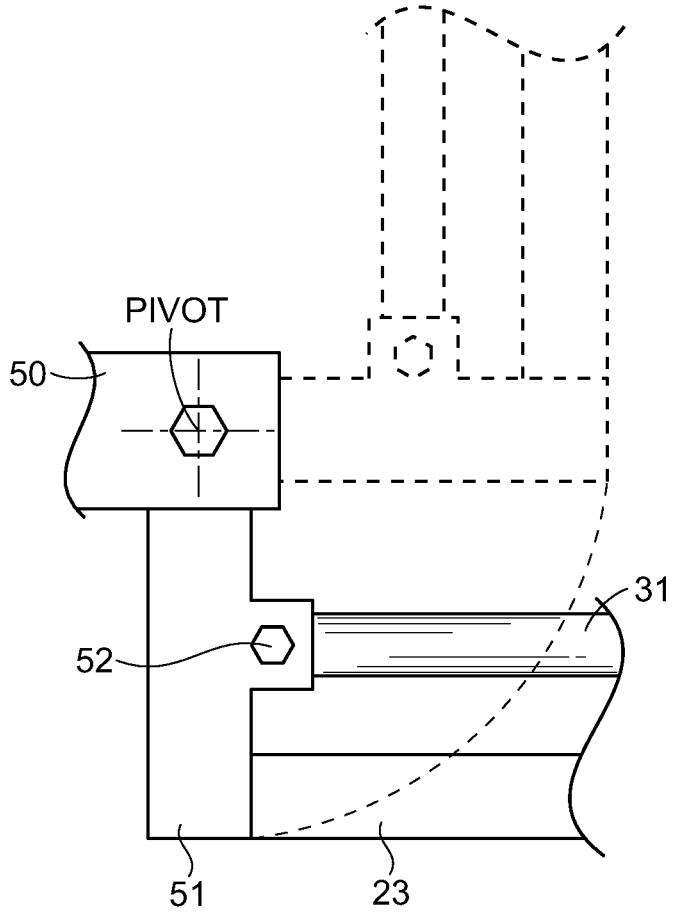
FIG. 8 is a detail view that illustrates the pivoting of the lower arm of a grain bin cover opening system in accordance with an example embodiment.

The lower arm 51 of the grain bin cover opening system pivots during operation of the actuator to increase the distance over which an opening force and a closing force can be exerted on the cover. This action is best shown in FIG. 8. As the cover 11 opens, the upper frame member 21 necessarily rotates counterclockwise as viewed in FIGS. 5A-5C. Due to the frame geometry, upper frame member 21 and lower arm 51 have a fixed angular relationship to each other. Specifically, in the example embodiment shown, they are parallel. This relationship causes lower arm 51 to pivot in the direction of opening, which is the opposite of what its direction would be without the frame, since actuator 30 would tend to push lower arm 51 clockwise. This counter-rotation of lower arm 51 allows the actuator system to open the grain bin cover farther than it would if the same actuator were simply mounted between the cover and the mount without any frame. This additional opening range also gives a wider opening for better access to the opening, as also shown in FIG. 2.

The push rod bolt 29 and the connection of the linear actuator 30 to the cover mount 40 is not conventional, in that the linear actuator 30 does not pivot relative to lower arm 51. Instead, bolt 29 simply holds the end of push rod 31 secure in the lower arm 51. As noted, in an example embodiment, the inner stiffener 23 slides into and out of the outer stiffener 22, as dictated by the motion of the push rod 31. The inner stiffener 23 and outer stiffener 22 thus act together to help keep the upper arm 26 and the lower arm 51 parallel, and also to add rigidity and reinforcement to the system, which includes the actuator 30.

Since the actuator 30 is electrically powered, any number of grain bin cover opening systems as shown can be wired in parallel and thus operated at the same time. It is also possible to power such multiple systems using power from one battery or vehicle electrical system, for example, by plugging the battery or system into a connector at ground level. It is also possible to operate one or more systems by remote control. Further, as discussed above, the actuator 30 may not only be electrically powered, but could also be powered by a hydraulic or pneumatic cylinder.

Figure 11:
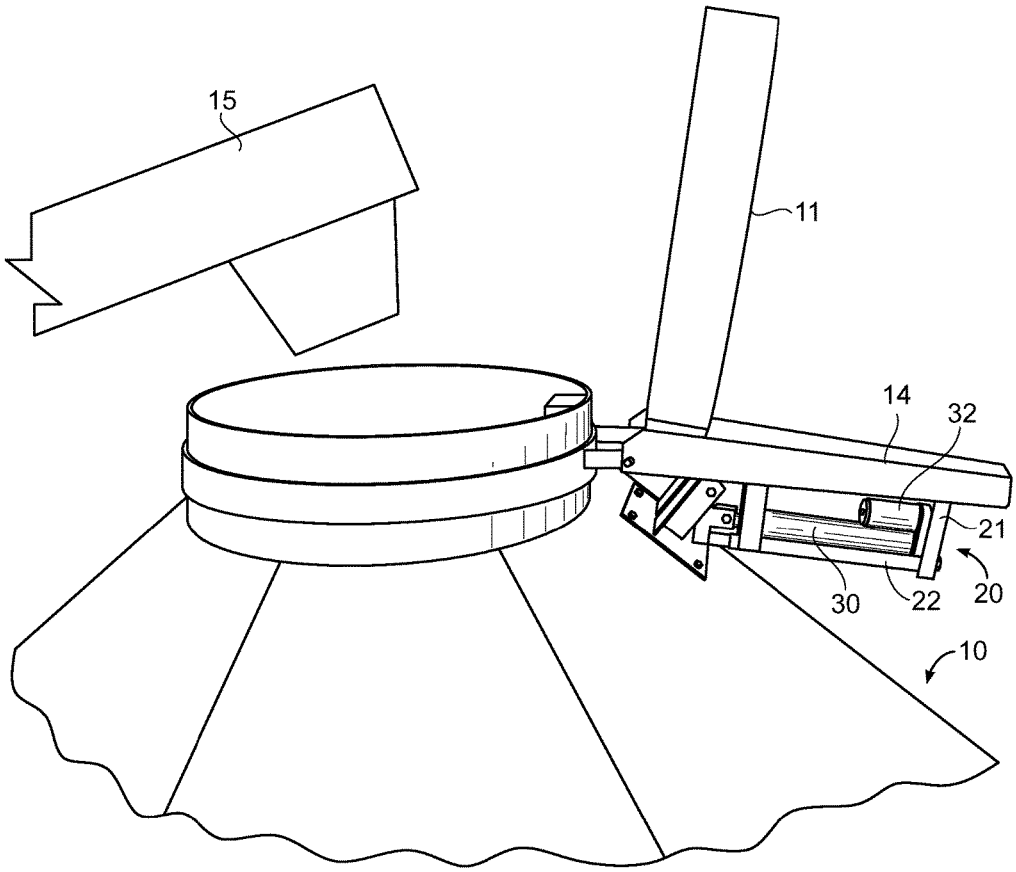
FIG. 11 is another detail perspective view of an alternative configuration of an installed grain bin cover opening system in accordance with an example embodiment, shown with the cover open.

The operation of the system is largely the same in the alternative embodiments shown in FIGS. 10 and 11, the grain bin cover opening system includes a cover extension 14 connected to the cover, and the upper arm 21 is connectable to the mount 40 which is attached to the cover extension (rather than directly to the cover). In this embodiment, operation of the actuator 30 exerts an opening force on the cover through the upper arm 21, the cover extension 14, and the mount 40. In this example, since the elements of the system are mounted outside the grain bin, a wide, unobstructed opening of the cover is possible. Further, since the actuator can be mounted with the motor near the moving point (opposite from the typical mounting configuration), the motor and actuation mechanism can be fully enclosed within the frame by the simple addition of a few sheets of metal or plastic (not shown) for protection from the elements.

In the outside mount configuration of FIGS. 10 and 11, the lift spring 70 will compress when the cover 11 is fully open, rather than when it is closed in the inside mount configuration. In addition, upper spring 42, rather than lower spring 41, will be compressed when the cover is closed. Thus, spring 42 will assist in opening the cover 11, while lift spring 70 and lower spring 41 will provide added force when closing the cover 11.

Unless otherwise defined, all technical and scientific terms used herein have the same meaning as commonly understood by one of ordinary skill in the art to which this invention belongs. Although methods and materials similar to or equivalent to those described herein can be used in the practice or testing of the grain bin cover opening system, suitable methods and materials are described above. All publications, patent applications, patents, and other references mentioned herein are incorporated by reference in their entirety to the extent allowed by applicable law and regulations. The grain bin cover opening system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A grain bin cover opening system, comprising:

an upper arm connected to a cover to raise or lower the cover;

a lower arm connectable to a fixed bracket;

an actuator operably coupled between the upper arm and the lower arm to move the upper arm away from or toward the lower arm;

an inner stiffener having a first end and a second end, the first end of the inner stiffener being coupled to the lower arm; and an outer stiffener coupled to the upper arm at a first end and having an opening at a second end to slidably receive the inner stiffener;

wherein the coupling of the inner stiffener to the lower arm maintains a substantially constant angle between the inner stiffener and the lower arm, and wherein the coupling of the outer stiffener to the upper arm maintains a substantially constant angle between the outer stiffener and the upper arm.

2. The grain bin cover opening system of claim 1, wherein the actuator comprises a linear actuator having a push rod.

3. The grain bin cover opening system of claim 2, wherein the push rod is substantially parallel to the inner stiffener.

4. The grain bin cover opening system of claim 1, wherein the inner stiffener slides into the outer stiffener when the actuator retracts.

5. The grain bin cover opening system of claim 1, further comprising a lift spring inside the outer stiffener that is compressed by the inner stiffener when the actuator retracts.

6. The grain bin cover opening system of claim 4, further comprising a lift spring inside the outer stiffener that is compressed by the inner stiffener when the actuator retracts.

7. The grain bin cover opening system of claim 1, wherein the lower arm is pivotally connectable to the fixed bracket.

8. The grain bin cover opening system of claim 7, wherein the lower arm pivots during operation of the actuator to increase the distance over which an opening force and a closing force can be exerted on the cover.

9. The grain bin cover opening system of claim 1, wherein the upper arm and the lower arm maintain a substantially constant angle relative to each other when the actuator is extended or retracted.

10. The grain bin cover opening system of claim 1, wherein the actuator and the outer stiffener are coupled to the upper arm through an upper frame member.

11. The grain bin cover opening system of claim 1, wherein the upper arm is connectable to a cover mount, and wherein operation of the actuator exerts an opening force on the cover through the upper arm and the cover mount.

12. The grain bin cover opening system of claim 11, wherein the cover mount is connectable to an inside of the cover.

13. The grain bin cover opening system of claim 12, wherein the upper arm comprises a spring engaging member and wherein the cover mount comprises a first mount spring, wherein the first mount spring is compressed by the spring engaging member when the actuator moves beyond a point where the cover is fully closed, the first mount spring exerting a locking force on the cover.

14. The grain bin cover opening system of claim 13, wherein the cover mount further comprises a second mount spring, wherein the spring engaging member is held between the first mount spring and the second mount spring.

15. The grain bin cover opening system of claim 1, wherein the upper arm is connectable to a cover mount, and wherein operation of the actuator exerts an opening force on the cover.

16. The grain bin cover opening system of claim 1, further comprising a cover extension connected to the cover, wherein the upper arm is connectable to a mount attached to the cover extension, and wherein operation of the actuator exerts an opening force on a cover through the upper arm, the cover extension, and the mount.

17. The grain bin cover opening system of claim 16, wherein the lower arm is pivotally connectable to a mounting bracket.

18. The grain bin cover opening system of claim 16, wherein the upper arm comprises a spring engaging member and wherein the mount comprises a first mount spring, wherein the first mount spring is compressed by the spring engaging member when the actuator moves beyond a point where the cover is fully closed, the first mount spring exerting a locking force on the cover.

19. The grain bin cover opening system of claim 16, further comprising a lift spring inside the outer stiffener that is compressed by the inner stiffener when the actuator retracts.

20. The grain bin cover opening system of claim 16, wherein the upper arm and the lower arm maintain a substantially constant angle relative to each other when the actuator is extended or retracted, and wherein the lower arm pivots during operation of the actuator to increase a distance over which an opening force and a closing force can be exerted on the cover.

* * * * *